US007699673B2

(12) United States Patent
Kawanishi et al.

(10) Patent No.: US 7,699,673 B2
(45) Date of Patent: Apr. 20, 2010

(54) CONTROLLER FOR BOAT PROPULSION SYSTEM AND BOAT PROPULSION SYSTEM

(75) Inventors: Masaru Kawanishi, Shizuoka (JP); Shu Akuzawa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 263 days.

(21) Appl. No.: 12/052,811

(22) Filed: Mar. 21, 2008

(65) Prior Publication Data

US 2008/0233812 A1 Sep. 25, 2008

(30) Foreign Application Priority Data

Mar. 23, 2007 (JP) ..... 2007-075955

(51) Int. Cl.
*B63H 21/22* (2006.01)

(52) U.S. Cl. ..... 440/1; 440/61 G

(58) Field of Classification Search ..... 440/1, 440/61 T, 61 G
See application file for complete search history.

(56) References Cited

U.S. PATENT DOCUMENTS 2,583,910 A * 1/1952 Watkins ..... 248/642
4,005,674 A * 2/1977 Davis ..... 440/1
5,037,338 A * 8/1991 Anderson et al. ..... 440/61 R
5,775,669 A * 7/1998 Huggins et al. ..... 248/640
6,149,476 A * 11/2000 Eilert ..... 440/53
6,691,023 B2 * 2/2004 Fujino et al. ..... 701/114
6,975,936 B2 12/2005 Akuzawa et al.
7,156,709 B1 * 1/2007 Staerzl et al. ..... 440/61 T
7,306,496 B1 * 12/2007 Carmen et al. ..... 440/6

FOREIGN PATENT DOCUMENTS

JP 2003-285796 A 10/2003

* cited by examiner

*Primary Examiner*—Stephen Avila
(74) *Attorney, Agent, or Firm*—Keating & Bennett, LLP

(57) ABSTRACT

A controller for a boat propulsion system has an adjusting device arranged to adjust an inclination angle in the vertical direction of the boat propulsion system by a drive unit, the controller arranged to perform drive control of the adjusting device, a storage section provided in the controller and arranged to store a limit value of the inclination angle, and a connector arranged to communicate with a service tool, wherein the controller is arranged to set the limit value from the service tool and stop the drive unit when the inclination angle reaches the limit value.

12 Claims, 13 Drawing Sheets

CONTROLLER FOR BOAT PROPULSION SYSTEM AND BOAT PROPULSION SYSTEM

BACKGROUND OF THE INVENTION

1. Field of the Invention

The present invention relates to a controller for a boat propulsion system capable of estimating a cause of trouble by connecting to a service tool, and to a boat propulsion system including the controller.

2. Description of the Related Art

An operation of a shift drive unit, a throttle drive unit, a tilt operation, and a trim operation can be performed by a controller in a boat propulsion system such as an outboard motor. The tilt operation raises the outboard motor above the water by tilting it upward, for example, when the boat is stopped or when the hull is lifted onto land. The trim operation adjusts an inclination angle (a trim angle) of the hull and the outboard motor to change a running position of the hull.

A boat propulsion system is designed so that the boat propulsion system can be mounted on boats of various sizes. Therefore, when an outboard motor is raised to a maximum upward tilted position, a portion of the boat propulsion system such as a front upper section and a handle of the boat propulsion system may interfere with the hull depending on a shape of the hull of the boat. That is why a boat propulsion system with which the inclination angle can be set and a lift that is equal to or greater than the set position cannot be made (see, for example, JP-A-2003-285796). Further, there is a boat propulsion system with which previous operating data is stored, the stored operating data is read out and displayed by a service tool, and a diagnosis is performed on the basis of the displayed operating data to estimate a cause of trouble of the engine or to perform an inspection for maintenance work (see, for example, JP-A-2004-36420).

In the conventional boat propulsion system described above, previous operating data can be stored and displayed. However, there may be a case in which the boat propulsion system is removed from the boat and the engine is replaced with an engine of a fuel injection type or a new function is added. Therefore, the importance of maintenance work and a setting of the engine is increased. Accordingly, service staff may perform a trim operation and a tilt operation by connecting to a service tool. In a case like this, when a tilt limit value corresponding to an environment in which the maintenance work or the setting is performed is not predetermined, a portion of the outboard motor may interfere with the hull when it is in an upward tilted position.

SUMMARY OF THE INVENTION

In order to overcome the problems described above, preferred embodiments of the present invention provide a controller for a boat propulsion system in which service staff can easily perform accurate work, and a boat propulsion system including the controller.

In order to achieve these advantages and benefits, preferred embodiments of the present invention are preferably defined as follows.

A first preferred embodiment of the present invention is directed to a controller for a boat propulsion system preferably including an adjusting device arranged to adjust an inclination angle in the vertical direction of the boat propulsion system by a drive unit, the controller arranged to perform drive control of the adjusting device; a storage section in the controller arranged to store a limit value of the inclination angle; and a connector arranged to be in communication with a service tool, in which the controller is arranged to set the limit value based on an input from the service tool and stop the drive unit when the inclination angle reaches the limit value.

A second preferred embodiment of the present invention is directed to the controller for a boat propulsion system preferably further including a storage section arranged to store an allowable inclination angle setting range, and a determination section arranged to determine whether the limit value is within the allowable inclination angle setting range.

A third preferred embodiment of the present invention is directed to the controller for a boat propulsion system in which the controller preferably prohibits setting the limit value when it is detected that an engine of the boat propulsion system is running.

A fourth preferred embodiment of the present invention is directed to the controller for a boat propulsion system in which the controller is preferably arranged to store the limit value in a plurality of areas in the storage section, and further includes a setting permission section arranged to determine whether the limit values stored in the plurality of the areas match.

A fifth preferred embodiment of the present invention is directed to the controller for a boat propulsion system in which the setting permission section preferably transmits display data of a message for drawing attention to the service tool when the inclination angle is equal to or greater than a prescribed angle during an operation of setting the limit value.

A sixth preferred embodiment of the present invention is directed to the controller for a boat propulsion system in which the setting permission section preferably transmits a display signal to a display device when it is determined that the limit value is out of the allowable inclination angle setting range during an operation of setting the limit value.

A seventh preferred embodiment of the present invention is directed to the controller for a boat propulsion system in which the controller is preferably arranged to reduce engine speed when the boat propulsion system is tilted to a prescribed angle or more while the engine is running.

An eighth preferred embodiment of the present invention is directed to the controller for a boat propulsion system in which a plurality of different limit values can preferably be set.

A ninth preferred embodiment of the present invention is directed to the controller for a boat propulsion system in which the limit value stored in the storage section can preferably be initialized by an operation of the service tool.

A tenth preferred embodiment of the present invention is directed to the controller for a boat propulsion system in which the controller is arranged to stop the engine when the inclination angle is equal to or more than a prescribed value while the engine speed is equal to or more than a prescribed speed when a shift position is in a forward drive or a reverse drive.

An eleventh preferred embodiment of the present invention is directed to the controller for a boat propulsion system in which the current limit value is preferably changed in accordance with the engine speed.

A twelfth preferred embodiment of the present invention is directed to a boat propulsion system including the controller according to any one of the preferred embodiments described above.

According to the preferred embodiments described above, the following advantages and benefits are achieved.

According to the first preferred embodiment of the present invention, the limit value of the inclination angle in the vertical direction of the boat propulsion system can be set from the service tool, and control for stopping the drive unit is performed when the inclination angle reaches the limit value. Accordingly, the limit value can be set corresponding to an environment in which maintenance work or a setting is performed. As a result, service staff can easily perform accurate work. Further, the limit value is set by the service tool, and therefore only service staff can set the limit value. As a result, a condition in which any user can set the limit value is reliably prevented.

According to the second preferred embodiment of the present invention, the controller of the boat propulsion system includes the storage section and the determination section. Therefore, a trim adjustment function can be achieved in a simple system configuration without adding another controller.

According to the third preferred embodiment of the present invention, setting the limit value is prohibited when it is detected that the engine of the boat propulsion system is running. Therefore, setting the limit value is prevented from becoming unstable during a rotation of the engine.

According to the fourth preferred embodiment of the present invention, the stored limit value is stored in a plurality of the areas in the storage section, and it is determined whether the limit values stored in the plurality of the areas match. Accordingly, when the limit value is stored in a plurality of the areas and is read out, and when it is also determined that the limit value in the plurality of the areas match, it can be confirmed that the limit value is surely set.

According to the fifth preferred embodiment of the present invention, display data of a message is transmitted to the service tool when the inclination angle is equal to or more than the prescribed angle during an operation for setting the limit value, and thus attention is drawn to the message. Therefore, incorrect work can be prevented, and it is prevented that a portion of the boat propulsion system interferes with the hull when the boat propulsion system is operated in an upward position.

According to the sixth preferred embodiment of the present invention, the display signal is transmitted to the display device when it is determined that the limit value is out of the allowable inclination angle setting range during an operation for setting the limit value. Therefore, it is prevented that a portion of the boat propulsion system interferes with the hull when the boat propulsion system is operated in an upward position.

According to the seventh preferred embodiment of the present invention, control for reducing engine speed is performed when the boat propulsion system is tilted to the prescribed angle or more while the engine is running.

According to the eighth preferred embodiment of the present invention, a plurality of different limit values can be set. As a plurality of different limit values can be set in accordance with an environment in which maintenance work or a setting is performed, it is more surely prevented that a portion of the boat propulsion system interferes with the hull, and service staff can easily perform accurate work.

According to the ninth preferred embodiment of the present invention, the limit value stored in the storage section can be initialized by an operation of the service tool, and it is prevented that the limit value is initialized by any user.

According to the tenth preferred embodiment of the present invention, the engine is stopped when the inclination angle is equal to or more than the prescribed value while the engine speed is equal to or more than the prescribed value when the shift position is in a forward drive or in a reverse drive. Therefore, it is prevented that a portion of the boat propulsion system interferes with the hull when the boat propulsion system is operated in an upward position.

According to the eleventh preferred embodiment of the present invention, the limit value in use is changed in accordance with the engine speed, and thus the limit value is variably set corresponding to an environment in which maintenance work or a setting is performed. Therefore, for example, it is more surely prevented that a portion of the boat propulsion system interferes with the hull corresponding to the specifications of the boat propulsion system, and service staff can easily perform accurate work.

According to the twelfth preferred embodiment of the present invention, the boat propulsion system is provided with the controller according to any one of the first to the eleventh preferred embodiments. Therefore, the limit value can be set corresponding to an environment in which maintenance work or a setting is performed for the boat propulsion system, and service staff can easily perform accurate work. Further, the limit value is set by the service tool, and therefore only service staff can set the limit value. As a result, a condition in which any user can set the limit value is reliably prevented.

Other features, elements, processes, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
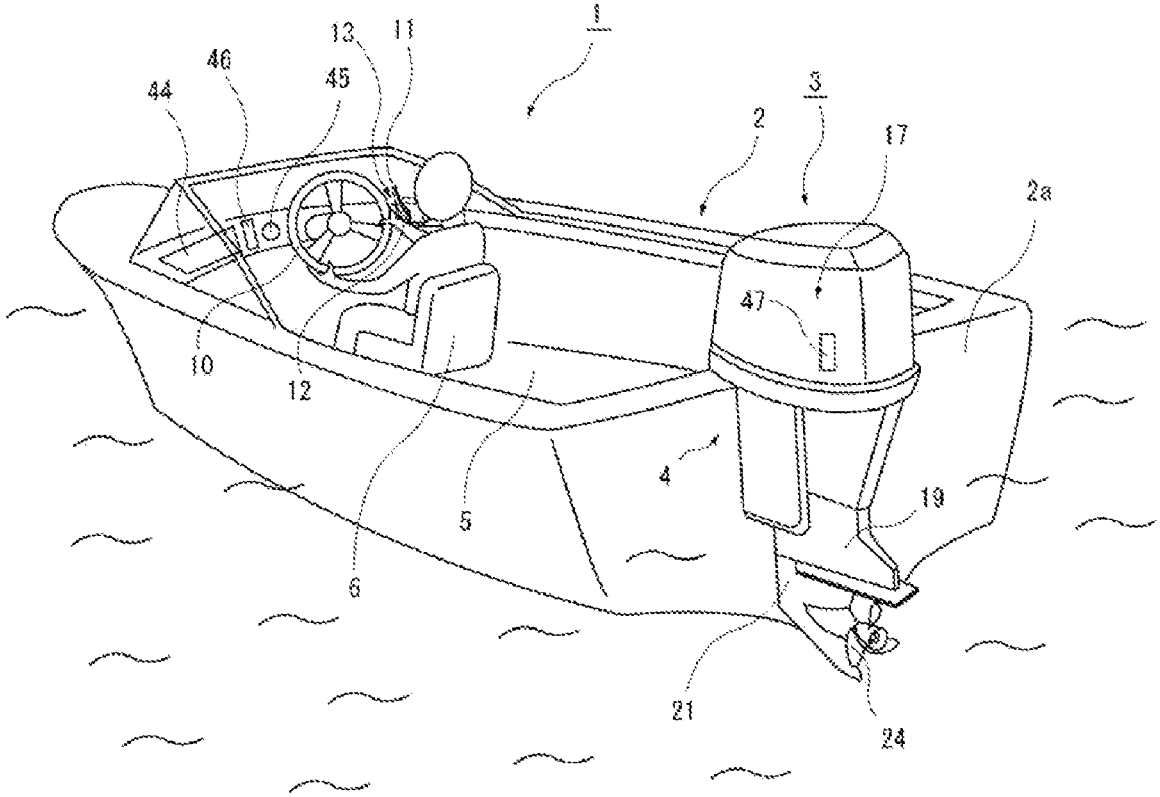
FIG. 1 is a perspective view seen from an obliquely rearward direction in a state in which a boat propulsion system is mounted on a boat.
Figure 2:
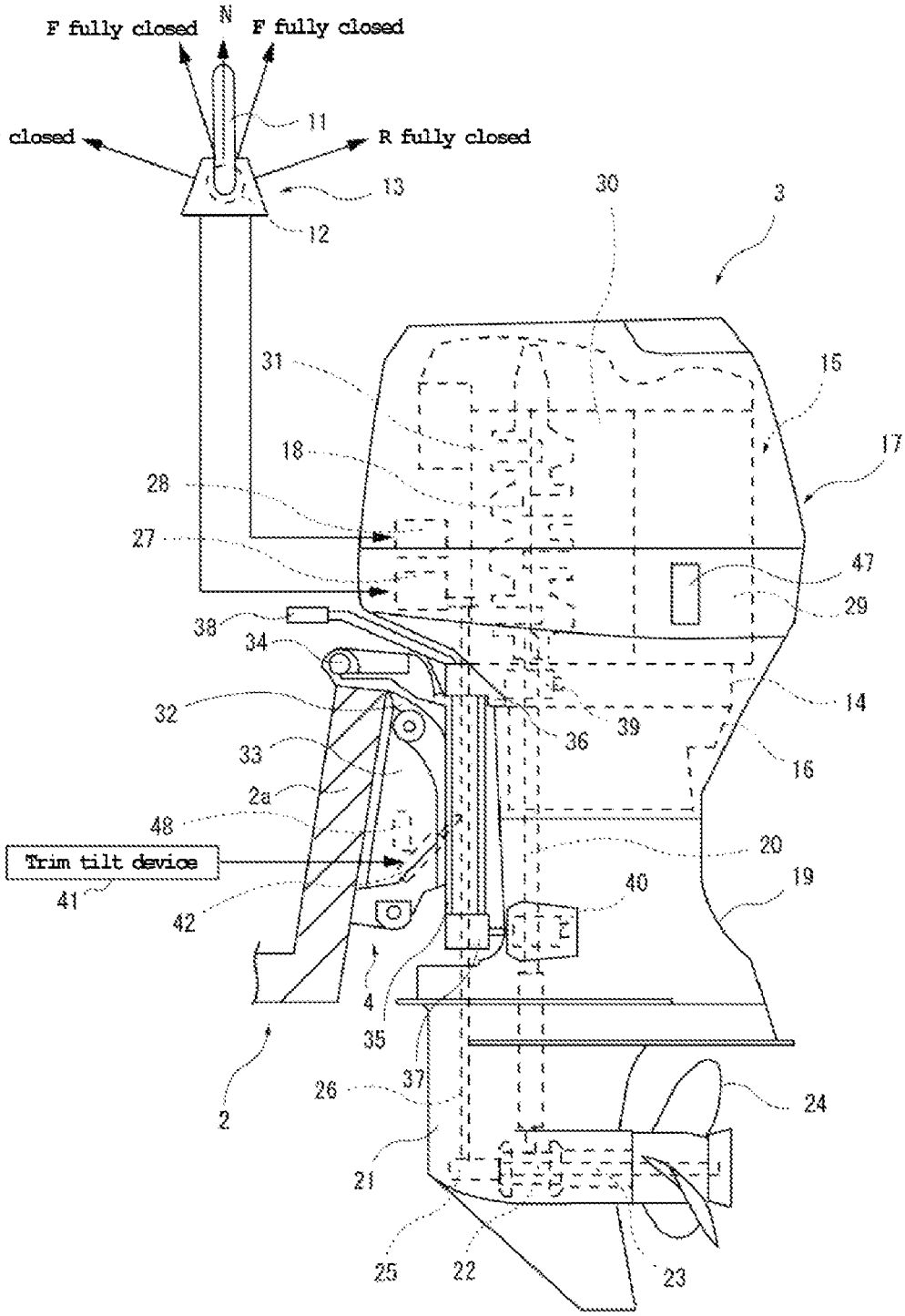
FIG. 2 is a left side view of the boat propulsion system mounted on the boat.

Preferred embodiments of the controller of a boat propulsion system and a boat propulsion system including the controller according to preferred embodiments of the present invention will be described hereinafter. The preferred embodiments of the present invention only illustrate the preferred embodiments. Therefore, the present invention is not limited to the preferred embodiments. FIG. 1 is a perspective view seen from an obliquely rearward direction in a state in which the boat propulsion system according to a preferred embodiment of the present invention is mounted on a boat. FIG. 2 is a left side view of the boat propulsion system mounted on the boat.

The present preferred embodiment can be applied to an outboard motor, an inboard-outboard motor, and the like as a boat propulsion system. In the present preferred embodiment, an outboard motor 3 is illustrated. For example, the outboard motor 3 is attached to a transom 2*a* positioned in a rear section of a hull 2 of a boat 1 via a bracket device 4. Further, the hull 2 has a wheelhouse 5 generally in a middle section in which a steering seat 6 and a steering wheel 10 are provided. Moreover, a remote controller 13 is provided at a side of the steering seat 6. The remote controller 13 is provided with an operating lever 11 positioned at a left side seen from the front direction of the boat and a lever position sensor 12 for detecting a lever position of the operating lever 11. The lever position sensor 12 is, for example, a potentiometer. The outboard motor 3 is electrically connected to the operating lever 11. An operation of a shift drive unit 27 and a throttle drive unit 28 of the outboard motor 3 is performed by the operating lever 11.

Specifically, a shift change by the shift drive unit 27 and a throttle opening by the throttle drive unit 28 are adjusted by the operating lever 11 to control propulsive forces such as the running speed and acceleration of the boat 1. As shown in FIG. 2, when the operating lever 11 is at a middle position, the shift position is in neutral (N); when the operating lever 11 is at a position forward of the middle position, the shift position is in a forward drive (F); and when the operating lever 11 is at a position rearward of the middle position, the shift position is in a reverse drive (R). When the shift position is in the forward drive (F) and the operating lever 11 is pushed further forward, a throttle is gradually opened from a forward fully closed throttle to a forward fully opened throttle. When the shift position is in a reverse drive (R) and the operating lever 11 is pulled further rearward, the throttle is gradually opened from a reverse fully closed throttle to a reverse fully opened throttle. As described above, the operator can control the propulsive force by opening or closing the throttle during a forward drive and a reverse drive, respectively.

As shown in FIG. 2, the outboard motor 3 is provided with an exhaust emission guide 14, and an engine 15 is provided above the exhaust emission guide 14. An oil pan 16 is disposed below the exhaust emission guide 14, and surrounding the engine 15, the exhaust emission guide 14, and the oil pan 16 of the outboard motor 3 is a cowling 17. The engine 15 is preferably an engine of a vertical type with a crankshaft 18 disposed generally in the vertical direction.

A drive shaft housing 19 is provided below the oil pan 16. A drive shaft 20 is disposed generally in the vertical direction in the exhaust emission guide 14, the oil pan 16, and the drive shaft housing 19. An upper end of the drive shaft 20 is connected to a lower end of the crankshaft 18. The drive shaft 20 is extended in a lower direction in the drive shaft housing 19 and connected to drive a propeller 24 via a bevel gear 22 and a propeller shaft 23 in a gear case 21 provided in a lower section of the drive shaft housing 19.

A shift device 25 for shifting a rotational direction of the propeller shaft 23 to a forward, a reverse, or a neutral state by remote control is provided in the gear case 21. A shift rod 26 is extended from the shift device 25 in an upward direction and operated by the shift drive unit 27.

The engine 15 mounted on the outboard motor 3 is preferably a water-cooled, four-cycle, four-cylinder engine including, for example, a cylinder head 29, a cylinder block 30, and a crankcase 31, and the so forth. The cylinder block 30 is disposed behind the crankcase 31 provided in a frontmost section of the engine 15. Further, the cylinder head 29 is disposed behind the cylinder block 30.

The bracket device 4 mainly includes a swivel bracket 32 and a transom bracket 33. The swivel bracket 32 is fixed to the outboard motor 3 and the transom bracket 33 is fixed to the transom 2*a* of the hull 2, respectively. The swivel bracket 32 is vertically tiltably supported with its shaft via a support shaft 34 provided between a pair of the transom brackets 33 at the left and at the right. A steering shaft 35 is vertically and rotatably supported with its shaft between the swivel brackets 32. Further, an upper mount bracket 36 and a lower mount bracket 37 are integrally rotatable on an upper end and a lower end of the steering shaft 35, respectively. In addition, a steering bracket 38 is provided to the upper mount bracket 36 and connected to the steering wheel 10 via a cable (not shown) or the like.

On the other hand, a pair of upper mount units 39 at the left and at the right is provided in a front section of the exhaust emission guide 14 and connected to the upper mount bracket 36. Further, a pair of lower mount units 40 is provided in both side sections of the drive shaft housing 19 and connected to the lower mount bracket 37. In addition, the outboard motor 3 is made operable in the horizontal direction with the steering shaft 35 at the center in relation to the bracket device 4 by an operation of the steering wheel 10, and a trim operation and a tilt operation in the vertical direction are made possible with the support shaft 34 at the center.

In the present preferred embodiment, the tilt operation raises the outboard motor 3 above the water, for example, when the boat is stopped or when the hull 2 is lifted onto land, and the trim operation adjusts an angle (a trim angle) between the hull 2 and the outboard motor 3 to change a running position of the hull 2. The outboard motor 3 illustrated in the present preferred embodiment has, for example, a trim angle of about 20 degrees from a lowest position to an upper position and an inclination angle of about 76 degrees from a full trim upper position to a further upper position. The trim angle and the inclination angle are controlled with hydraulic pressure by a hydraulic device 42 in accordance with instructions from a trim tilt device 41. The trim tilt device 41 defines a drive unit which operates the outboard motor 3 in the vertical direction.

The trim tilt device 41 is used by the operator to perform remote control of a trim operation and a tilt operation of the outboard motor 3 and is actuated by operating a trim tilt operation switch 46. The trim tilt operation switch 46 and a main switch 45 are provided in a position in which the operator can easily operate these switches, for example, along with a display device 44, the remote controller 13, and the like in an instrument panel or the like of the boat 1. Further, as shown in FIG. 2, a trim tilt operation switch 47 is also provided on the outboard motor 3 to perform an operation from the outside of the boat 1.

Further, an inclination angle detection sensor 48 for sensing a relative position of the hull 2 and the outboard motor 3 or, in other words, a relative angle in general, which is the trim angle and the tilt angle of the outboard motor 3, is provided on the bracket device 4, for example.

Figure 3A:
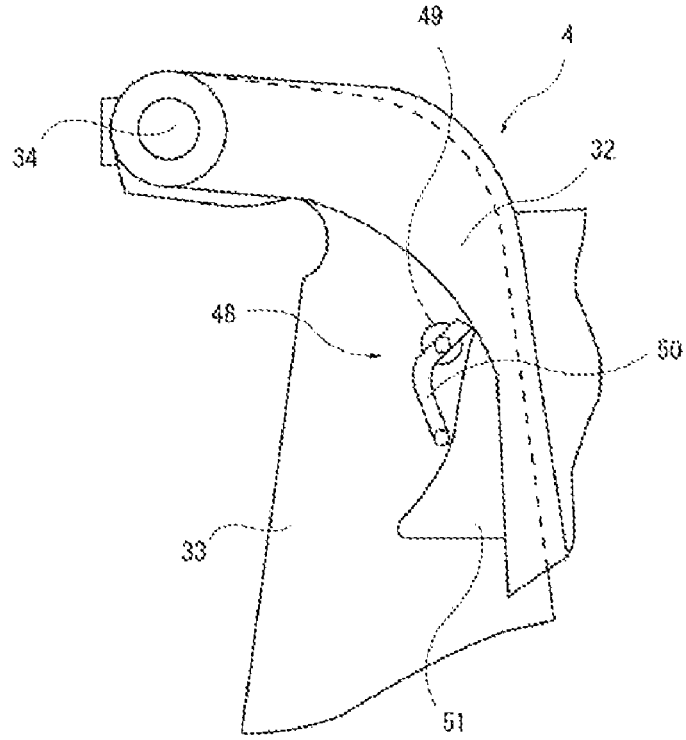
FIGS. 3A and 3B are views explaining an inclination angle detection sensor.
Figure 3B:
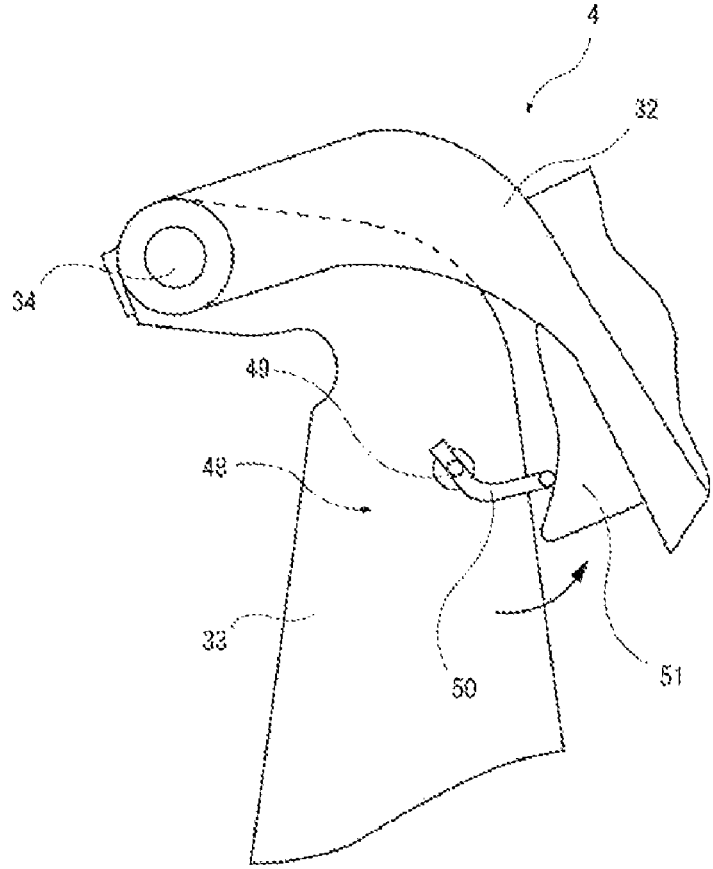

The inclination angle detection sensor 48 is shown in FIGS. 3A and 3B. FIG. 3A shows a state in which the outboard motor 3 is in a lower position, while FIG. 3B shows a state in which the outboard motor 3 is in an upper position. The inclination angle detection sensor 48 includes, for example, a rotation sensing element 49, for example, such as a variable resistor and a Hall element provided on the transom bracket 33 as a fixed side, a lever 50 rotatably provided on the rotation sensing element 49, and a protrusion 51 provided on the swivel bracket 32 as a movable side. A free end of the lever 50 is constantly biased toward the protrusion 51 by a spring (not shown) or the like and in contact with the protrusion 51. For instance, when the outboard motor 3 is tilted up, the swivel bracket 32 is tilted in the vertical direction via the support shaft 34. Accordingly, the protrusion 51 moves at the same time with the tilting, and the lever 50 rotates around the rotation sensing element 49. As a result, the amount of the rotation or, in other words, an inclination angle signal of the outboard motor 3 is output.

Figure 4:
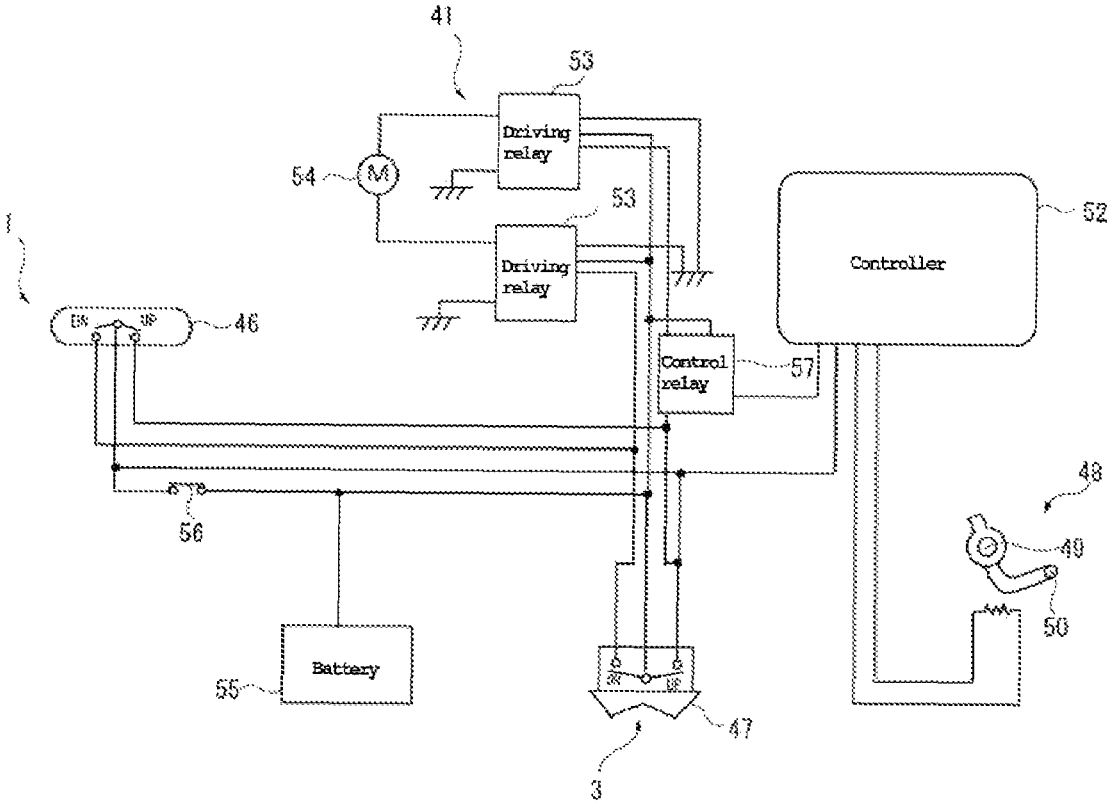
FIG. 4 is a circuit diagram of a trim tilt device.
Figure 5:
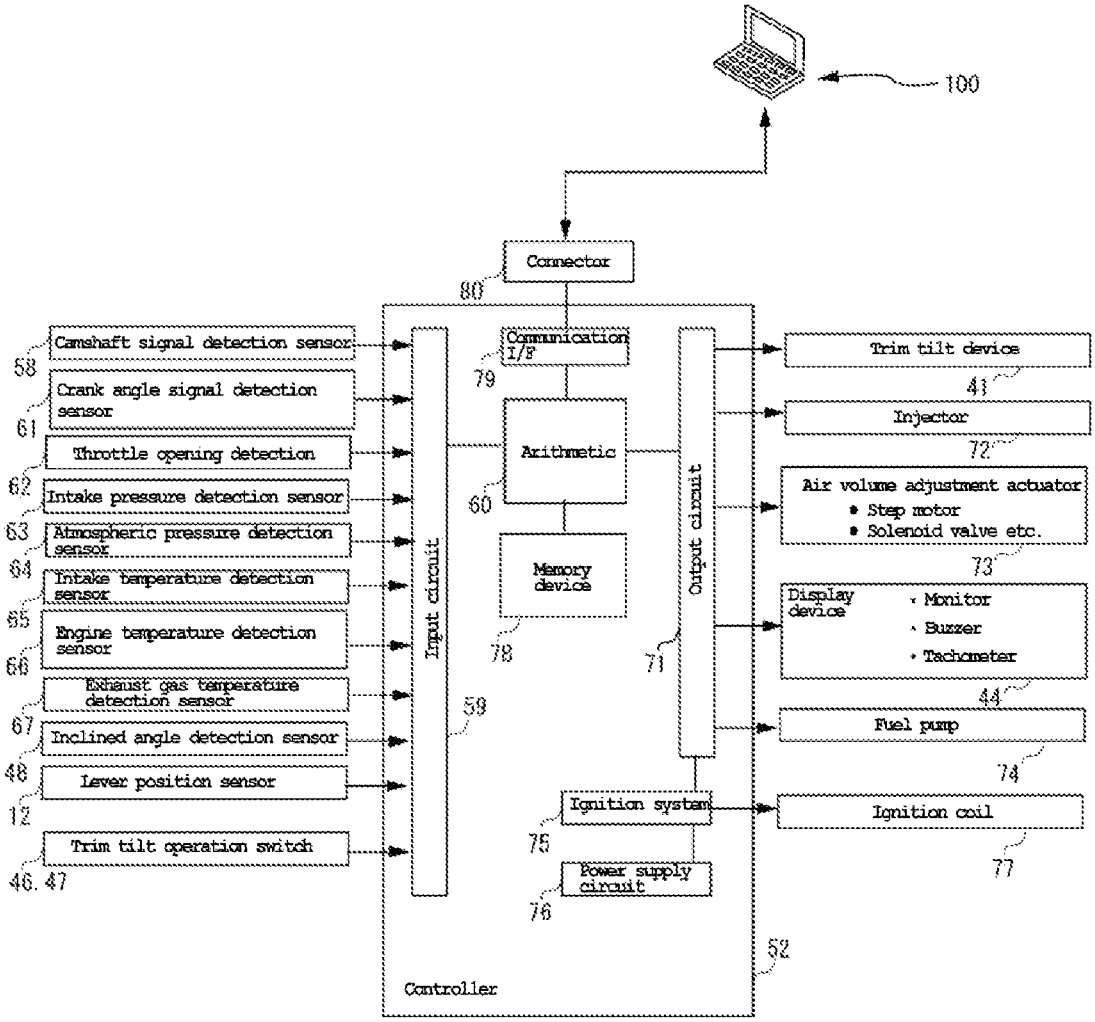
FIG. 5 is a system chart of a controller of an outboard motor.

The trim tilt device 41 will be described hereinafter with reference to FIG. 4 and FIG. 5. FIG. 4 is a circuit diagram of the trim tilt device 41. FIG. 5 is a system chart of a controller 52 of the outboard motor 3 including the trim tilt device 41.

As shown in FIG. 4, an up side and a down side of the trim tilt operation switches 46 and 47 provided on the boat 1 and on the outboard motor 3 are connected to a driving relay 53, respectively, and thus operate a drive motor 54 as a power source of the hydraulic device 42 for vertically tilting the outboard motor 3. The trim tilt operation switch 46 on a side of the boat 1 is disposed between the drive motor 54 and a battery 55 as a power source of the drive motor 54 (also used as a power supply of the controller 52). Moreover, an ignition switch 56 is provided between the trim tilt operation switch 46 and the battery 55. Further, a control relay 57 which is opened or closed by an operation of the controller 52 is disposed between the drive motor 54 and the trim tilt operation switches 46 and 47.

As shown in FIG. 5, various types of information are input from each of equipment inside and outside the outboard motor 3 to the controller 52. Specifically, for example, a signal of a camshaft (not shown) in the engine 15 (a cam angle signal) is input to an arithmetic section 60 (a CPU, a RAM, and a ROM) in the controller 52 via an input circuit 59 from a camshaft signal detection sensor 58. A rotational speed signal of the engine 15 from a crank angle signal detection sensor 61, an opening of a throttle defining an engine intake system (not shown) from a throttle opening detection sensor 62, inlet pressure and atmospheric pressure, respectively, from an intake pressure detection sensor 63 and an atmospheric pressure detection sensor 64, and temperature of intake air, temperature of the engine 15 (cooling water temperature), and temperature of exhaust gas, respectively, from an intake temperature detection sensor 65, an engine temperature detection sensor 66, and an exhaust gas temperature detection sensor 67 are input to the arithmetic section 60.

Moreover, an inclination angle signal of the outboard motor 3 from the inclination angle detection sensor 48 and a shift position signal and a throttle position signal from the lever position sensor 12 provided in the remote controller 13 are respectively input to the arithmetic section 60. Further, an up signal and a down signal for performing a trim operation and a tilt operation are respectively input from the trim tilt operation switches 46 and 47 to the arithmetic section 60.

Information on each equipment input to the controller 52 is appropriately processed and calculated in the arithmetic section 60 and output to each of equipment inside and outside the outboard motor 3 via an output circuit 71. Specifically, for example, the drive motor 54 is operated by operating the control relay 57 of the trim tilt device 41. Further, for example, injection amount information of fuel to an injector 72, an adjustment signal of an intake air volume to a stepper motor, a solenoid valve (both not shown), and the like in an actuator 73, a signal for transferring an abnormality in an engine speed signal and in each equipment to a monitor, a buzzer, a tachometer, and the like of the display device 44, and supply amount information on fuel to a fuel pump 74 are output, respectively. Moreover, the arithmetic section 60 outputs an ignition signal from the output circuit 71 to an ignition coil 77 via an ignition system 75 (to which a power supply circuit 76 is connected).

As described above, with the outboard motor 3, an operation of the shift drive unit 27 and the throttle drive unit 28 is possible, a trim operation and a tilt operation are possible, and previous operating data of the engine 15 is stored in a storage section 78 in an EEPROM or the like of the controller 52. A service tool 100 is connected to the controller of the outboard motor 3 via a connector 80, and operation data stored in the storage section 78 is read out and displayed by the arithmetic section 60 and a communication interface 79. Thus, diagnosis on the basis of the displayed operation data is made possible.

Maintenance work or settings of the engine 15 of the boat 1 may be performed with the outboard motor 3 raised above the water by a tilt operation, for example, when the boat is stopped or when the hull 2 is lifted onto land. In a case like this, when a limit value of the inclination angle is set of the outboard motor 3 corresponding to an environment in which the maintenance work or the setting is performed, a portion of the outboard motor 3 may interfere with the hull 2 when the motor 3 is in the tilted upward position.

Figure 6:
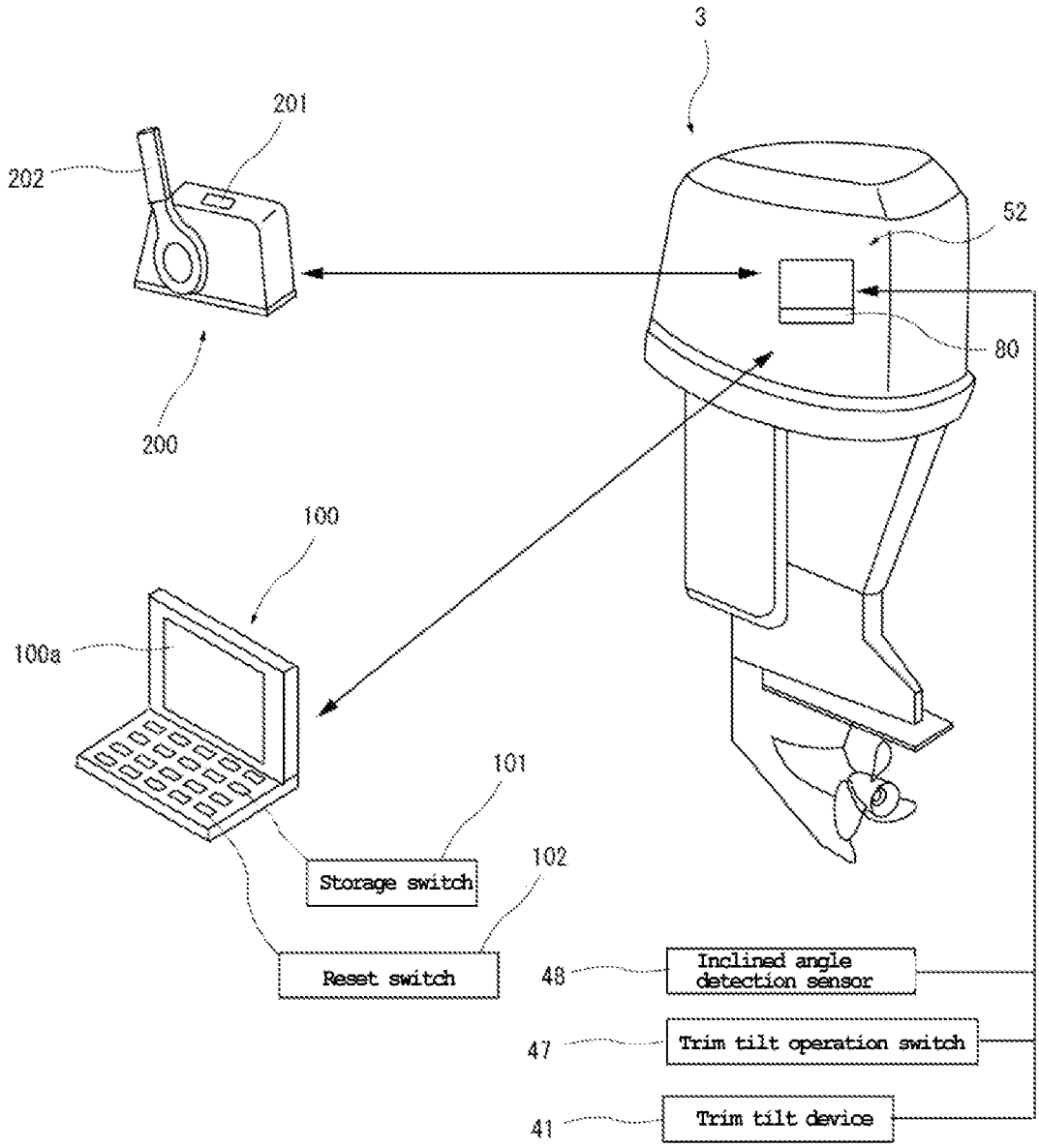
FIG. 6 is a view illustrating an arrangement of the controller of the outboard motor.
Figure 7A:
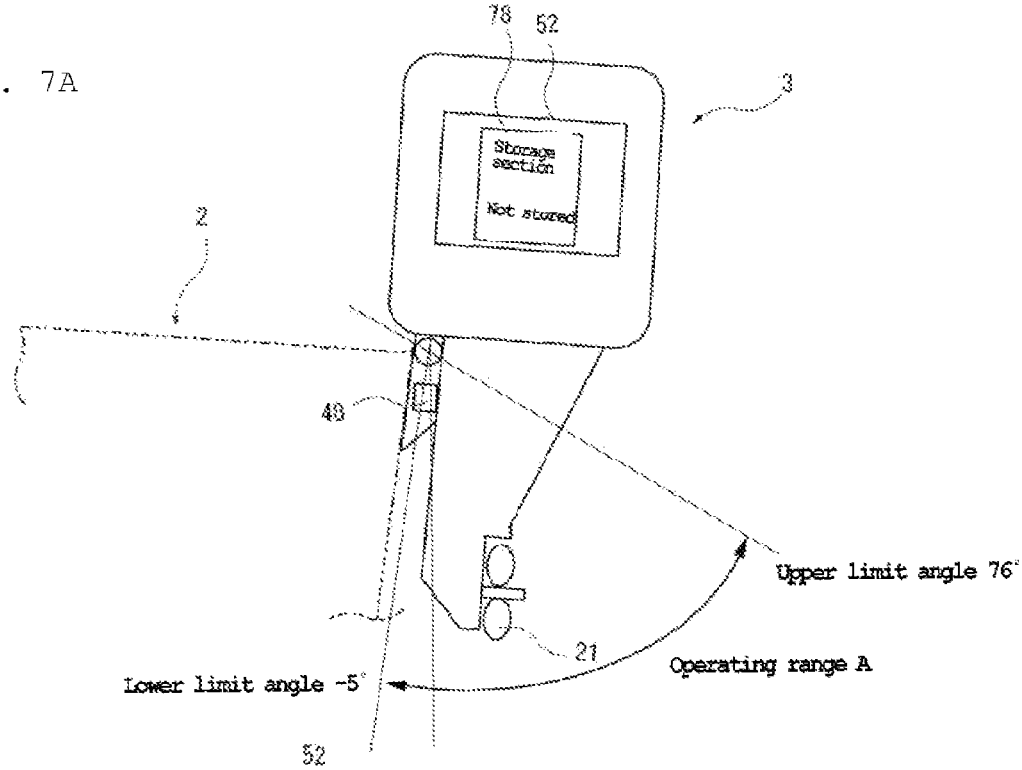
FIGS. 7A and 7B are views illustrating setting a limit value.
Figure 7B:
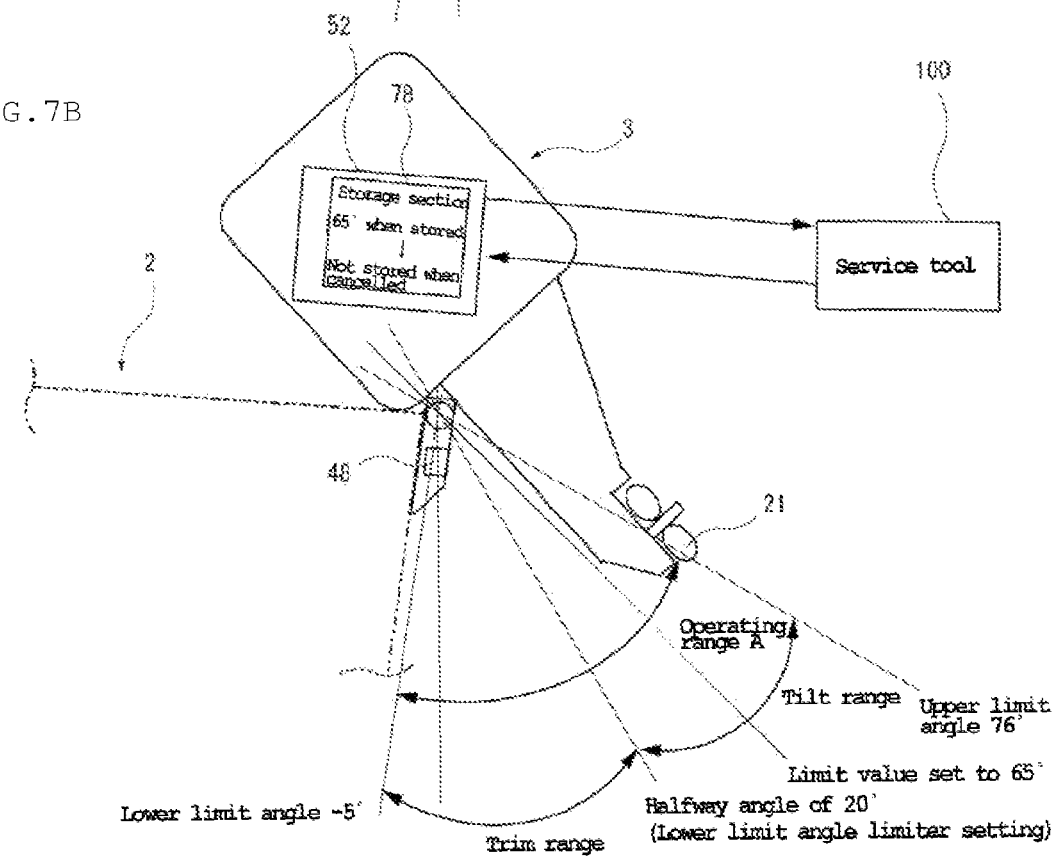
Figure 8A:
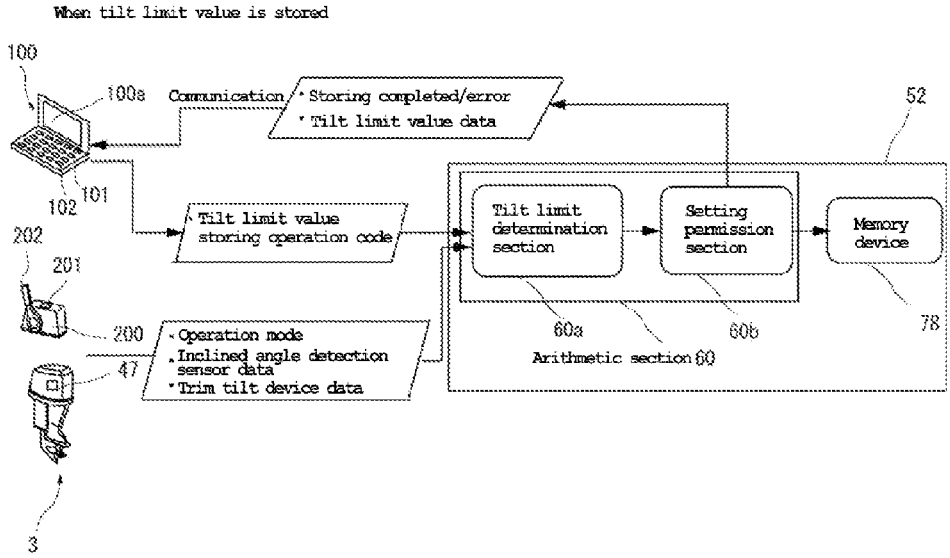
FIGS. 8A and 8B are block diagrams explaining a process for storing a limit value by a service tool.
Figure 8B:
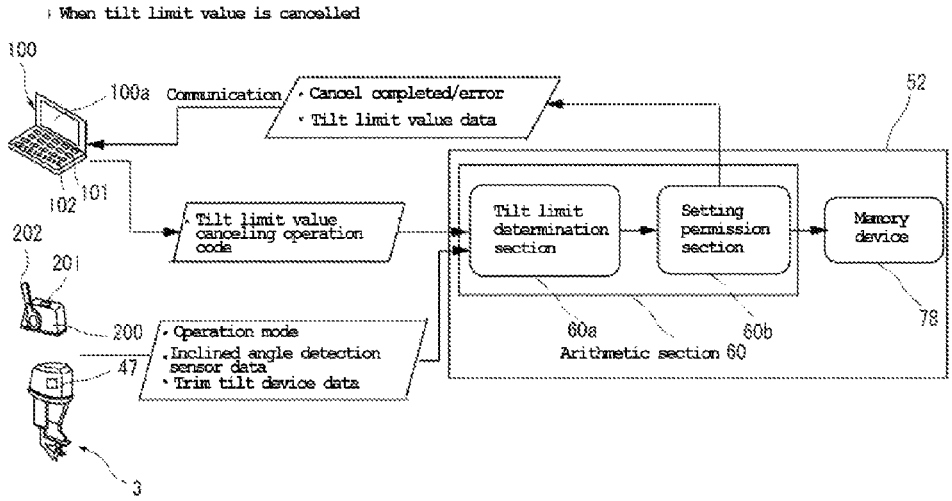
Figure 9:
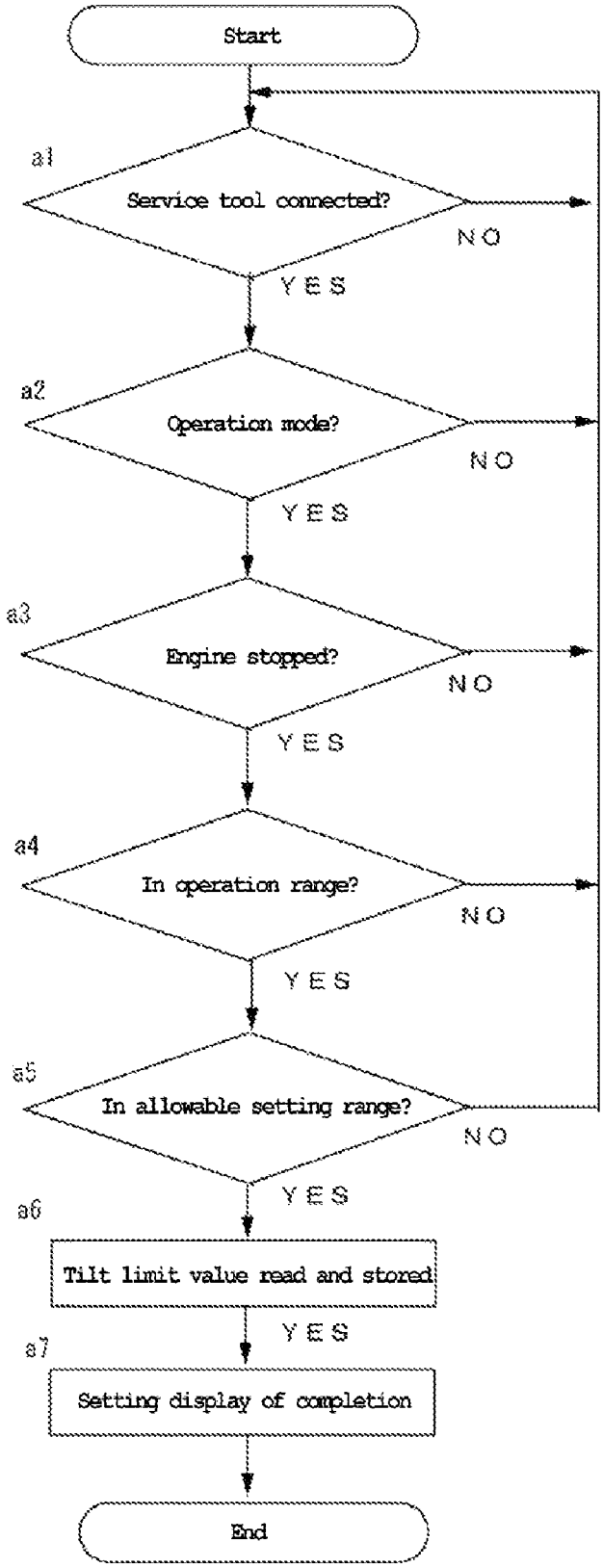
FIG. 9 is a flow chart of setting a limit value.

With this problem considered, when service staff perform a trim operation and a tilt operation by connecting the service tool 100, a maximum upward tilt position of the outboard motor 3 can be set by a method of setting the upward tilted stop position described below in order for a portion of the outboard motor 3 not to interfere with the hull 2 when the motor 3 is tilted upward. FIG. 6 is a view illustrating the controller of the outboard motor. FIG. 7 is a view illustrating setting the limit value. FIG. 8 is a block diagram explaining a process for storing the limit value by the service tool. FIG. 9 is a flow chart of setting the limit value.

As shown in FIG. 6, the service tool 100 is connected to be in communication with the controller 52 of the outboard motor 3 via the connector 80, and information is transferred by communication between the service tool 100 and the controller 52. Further, a servicing remote controller 200 is in communication with the controller 52 via the connector 80, and a remote control main switch 201 of the remote controller 200 is turned on. In this state, drive control of the trim tilt device 41 as a drive unit defining an adjusting device is performed via the controller 52 by an operation of a remote control trim tilt operation switch 202, and an adjustment of an inclination angle in the vertical direction of the outboard motor 3 is performed. As described above, the trim operation and the tilt operation is performed by an operation of the remote control trim tilt operation switch 202, and thus the adjustment of the inclination angle in the vertical direction of the outboard motor 3 can be performed. In addition, the trim operation and the tilt operation can be performed by the trim tilt operation switch 47 of the outboard motor 3. Further, the trim operation and the tilt operation can also be performed by the trim tilt operation switch 46 provided on the boat 1.

The service tool 100 displays information on a limit value setting mode or the like on a monitor screen 100*a*. As shown in FIG. 7, the limit value, for example, of 65 degrees is set by an operation of a storage section switch 101 within an operating range (A) in which the outboard motor 3 is tilted, and the limit value can be stored in the storage section 78 provided in the controller 52. The operating range (A) in which the outboard motor 3 is tilted is stored beforehand in the storage section 78 for the outboard motor 3. In the operating range (A), for example, a lower limit angle is −5 degrees, an upper limit angle is 76 degrees, a halfway angle between a trim and a tilt is 20 degrees, a range from the lower limit angle of −5 degrees to the halfway angle of 20 degrees is a trim range, and a range from the halfway angle of 20 degrees to the upper limit angle of 76 degrees is a tilt range. In the present preferred embodiment, the lower limit angle of −5 degrees indicates a position which is achieved by a rotation of 5 degrees more from a vertical position to a side of a stern board. The halfway angle of 20 degrees indicates a lower limit angle of setting a limiter. Specifically, for example, a trim range of about 20 degrees from the lowest position to an upper position and a tilt range of about 76 degrees from a full trim upper position to a further upper position are provided. A limit value, for example, of 65 degrees is set within the range of the tilt range and stored in the storage section 78. Further, setting of the limit value, for example, of 65 degrees stored in the storage section 78 by an operation of a reset switch 102 can be initialized and deleted. In the present preferred embodiment, the limit value, for example, of 65 degrees is set. However, a setting which prevents a portion of the outboard motor 3 from interfering with the hull during a tilt up position can be made in the tilt range corresponding to an environment in which maintenance work or setting is performed. In addition, the controller 52 performs control for stopping an operation of the trim tilt device 41 as a drive unit when the inclination angle reaches the limit value.

Storing a limit value and cancelling a limit value by the service tool 100 will be described hereinafter. As shown in FIGS. 8A and 8B, the arithmetic section 60 has a determination section 60*a* and a setting permission section 60*b* which operates as shown in FIG. 8A when a limit value is stored, and operates as shown in FIG. 8B when a limit value is cancelled.

As shown in FIG. 8A, when a limit value is stored, the remote control main switch 201 is turned on, and the limit value setting mode is activated. As the remote control trim tilt operation switch 202 is operated, the outboard motor 3 is tilted up as a result of hydraulic pressure by the hydraulic device 42 depending on the trim tilt device 41. All information including information on the limit value setting mode such as an inclination angle of the outboard motor 3 obtained, for example, from the trim tilt device 41 and the inclination angle detection sensor 48 is input to the controller 52.

In addition, as a limit value storing operation code is input by an operation of the service tool 100, information from the controller 52 such as an angle of tilting up, a limit value, completion of storing, and an error is transmitted and can be displayed on the monitor screen 100*a*.

In the determination section 60*a*, determination of the operating range (A) is performed, in which a limit value input by an operation of the storage section switch 101 of the service tool 100 is set. Moreover, an allowable inclination angle setting range such as the tilt range is determined. When the limit value is in the allowable inclination angle setting range, the limit value is stored in the storage section 78 by the setting permission section 60*b*. When the limit value is out of the allowable inclination angle setting range, information on an error is transmitted to the service tool 100 by the setting permission section 60*b*. In addition, when an operation for setting a limit value is performed, when the inclination angle is equal to or more than a prescribed angle, the setting permission section 60*b* transmits display data of a message for drawing attention to the service tool 100. As a result, incorrect work can be prevented, and it is prevented that a portion of the outboard motor 3 interferes with the hull when the outboard motor 3 is operated in an upward position. Further, when an operation for setting a limit value is performed, when it is determined that the limit value is out of the allowable inclination angle setting range, the setting permission section 60*b* transmits a display signal to the display device 44. As a result, it is prevented that a portion of the outboard motor 3 interferes with the hull when the outboard motor 3 is operated in an upward position. Still further, when the engine 15 is running, and the outboard motor 3 is tilted to a prescribed angle or more, the setting permission section 60*b* performs control for reducing engine speed.

As described above, the limit value can be set within the operating range (A) and within the allowable inclination angle setting range and stored in the storage section 78 by an operation of the service tool 100. Service staff can set the limit value corresponding to an environment in which maintenance work or setting is performed, and service staff can easily perform accurate work. In addition, the limit value is set by the service tool, and therefore only service staff can set the limit value. A condition in which any user can set the limit value is reliably prevented. Further, an allowable inclination angle setting range such as the tilt range within which the limit value is set is determined, and the limit value is set only in the tilt range. As a result, it is prevented that a trim adjustment cannot be performed during running because of a setting of a trim range made, for example, by incorrect work.

Further, when the setting permission section 60*b* detects a state in which the engine 15 of the outboard motor 3 is running, the setting permission section 60*b* prohibits setting the limit value and transmits information on an error to the service tool 100. As described above, when it is detected that the engine 15 of the outboard motor 3 is running, setting the limit value is prohibited, and an error is displayed. As a result, it is prevented that setting the limit value becomes unstable by a rotation of the engine 15.

Further, the setting permission section 60*b* stores the limit value stored in the storage section 78 in a plurality of areas and reads out the limit value stored in the plurality of the areas to determine whether the limit values stored in the plurality of the areas match. The limit value may be set by executing limit value setting processing. However, it is not confirmed that the limit value is actually set. On the other hand, when the limit value is stored in a plurality of the areas, and when the plurality of the stored limit values are read out to determine whether the plurality of the stored values match, it can be confirmed that the limit value is surely set.

Further, the setting permission section 60*b* transmits the stored limit value to the service tool 100 with a completion message after a setting is completed. Even when it is confirmed that the limit value is set, it is not known that the limit value is an intended limit value. On the other hand, when the stored limit value is transmitted to the service tool 100 with the completion message to display the limit value after a setting is completed, it is known whether or not the limit value is the intended limit value. As a result, service staff can double-check their work.

In addition, a plurality of different limit values can be set in the storage section 78, and a plurality of different limit values can be set in accordance with an environment in which maintenance work or a setting is performed. As a result, it is more surely prevented that a portion of the outboard motor 3 interferes with the hull, and service staff can easily perform accurate work. Further, the limit value used in accordance with engine speed can be changed, and the limit value is changed for a setting corresponding to an environment in which maintenance work or a setting is performed. As a result, it is more surely prevented that a portion of the outboard motor 3 interferes with the hull, for example, corresponding to specifications of the outboard motor 3, and service staff can easily perform accurate work.

As shown in FIG. 8B, when the limit value is cancelled, the remote control main switch 201 is turned on, and the limit value setting mode is activated. As a result, all information on the limit value setting mode is input to the controller 52 as well as when the limit value is stored. Further, information from the controller 52 such as an angle of tilting up, a limit value, completion of initialization, and an error is transmitted and can be displayed on the monitor screen 100*a*.

Moreover, as the limit value cancel operation code is input by an operation of the service tool 100, information from the controller 52 such as an angle of tilting up, a limit value, completion of initialization, and an error is transmitted and can be displayed on the monitor screen 100*a*.

The determination section 60*a* determines whether or not the limit value stored in the storage section 78 can be initialized by an operation of the reset switch 102 of the service tool 100. When initialization is possible, the limit value stored in the storage section 78 by the setting permission section 60*b* is initialized, and completion of initialization is transmitted and can be displayed on the monitor screen 100*a*.

As described above, the limit value stored in the storage section 78 can be initialized by an operation of the service tool 100, and initializing the limit value is solely performed by service staff because the limit value is initialized by the service tool 100. As a result, it is prevented that the limit value is initialized by any user. When the limit value cannot be initialized, information on an error is transmitted to the service tool 100 by the setting permission section 60*b*.

Further, the setting permission section 60*b* initializes the limit value stored in the storage section 78, stores the initialized limit value in a plurality of areas, and reads out the limit value stored in the plurality of the areas to determine whether the plurality of the stored values match. As the initialized limit value is stored in a plurality of the areas, and also as the limit value stored in a plurality of the areas is read out to determine that the plurality of the stored values match, it can be confirmed that the limit value is surely initialized.

Further, the setting permission section 60*b* transmits the initialized limit value to the service tool 100 with a completion message after initialization is completed, and the limit value is displayed. As a result, it is known whether or not the limit value is the intended limit value, and service staff can double-check their work.

Setting the limit value in which the limit value is set within the operating range (A) and stored in the storage section 78 by the service tool 100 will be described hereinafter with reference to FIG. 9.

In Step a1, it is determined whether or not service staff has connected the service tool 100 to the controller 52.

In Step a2, when the service tool 100 is connected, it is determined whether or not the outboard motor 3 is in the limit value setting mode. An upward tilting operation can be performed by placing the outboard motor 3 in the limit value setting mode.

In Step a3, when the outboard motor 3 is in the limit value setting mode, it is determined whether or not the engine 15 is in a stopped state. This is because the upward tilting operation of the outboard motor 3 is not normally performed while the engine 15 is running.

In Step a4, when it is determined that the engine 15 is in the stopped state, it is determined whether or not the inclination angle is within the operating range by detecting the inclination angle from the inclination angle detection sensor 48. As a result, it is determined whether or not the inclination angle detection sensor 48 is normal or, in other words, is not in trouble.

In Step a5, when it is determined that the inclination angle detection sensor 48 is normal or, in other words, is not in trouble, it is determined whether or not an upward tilting angle is within the allowable inclination angle setting range or, in other words, within the tilt range.

In Step a6, when it is determined that the upward tilting angle is within the allowable inclination angle setting range or, in other words, within the tilt range, the limit value of the inclination angle is input by an operation of the service tool 100, and the limit value is read by performing a switch operation of the storage section switch 101 to store the limit value in the storage section 78.

In Step a7, the limit value stored in the storage section 78 is stored in a plurality of areas, and the limit value stored in the plurality of the areas is read out. Further, it is determined whether the plurality of the stored values match. The stored limit value is transmitted to the service tool 100 with a completion message to display the limit value after a setting is completed.

Figure 10:
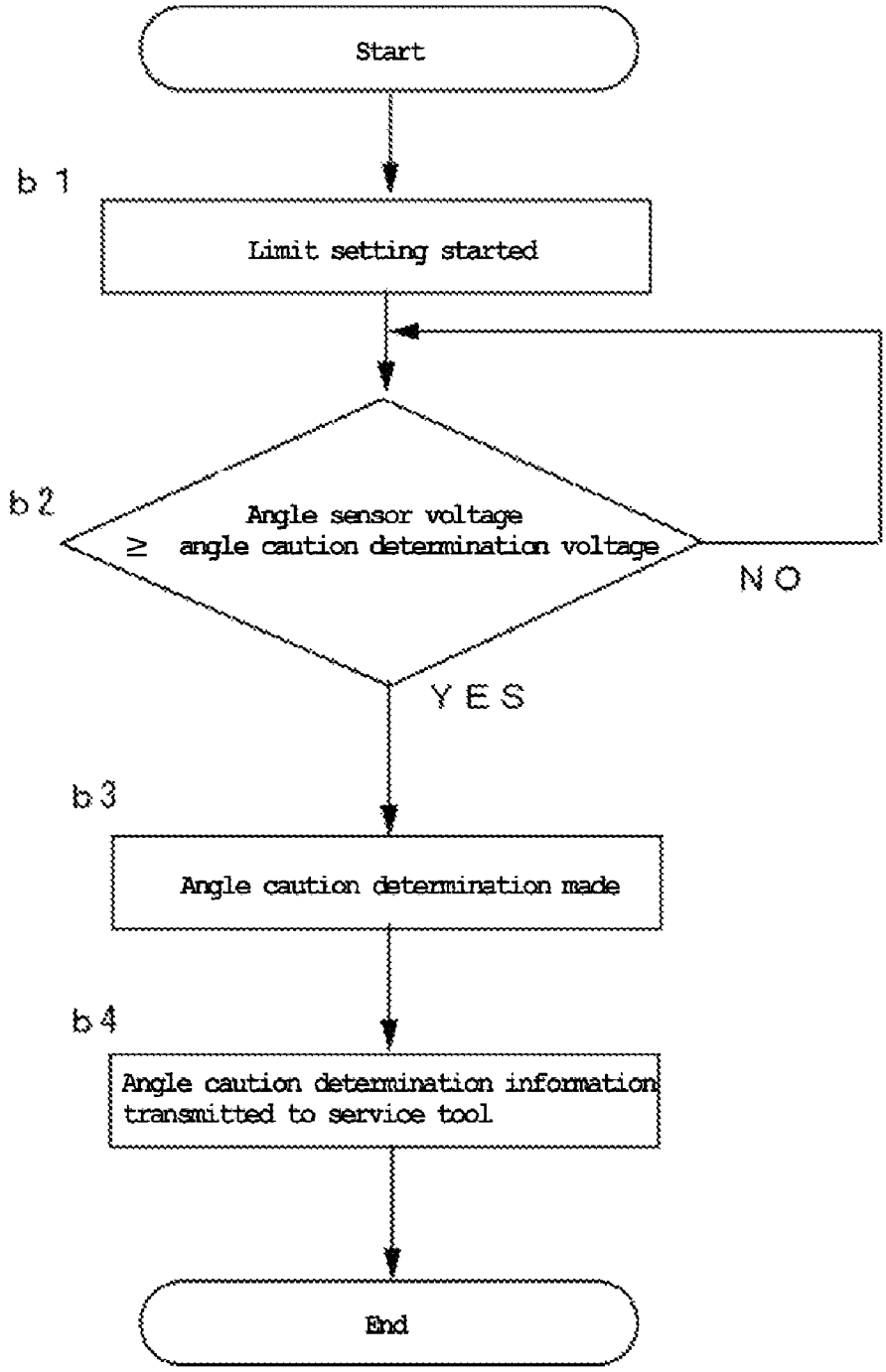
FIG. 10 is a flow chart for drawing attention when an inclination angle is equal to or more than a prescribed angle even within a tilt range during an operation for setting a limit value.

Further, when an operation for setting the limit value is performed, and when the inclination angle of the propulsion unit 3 obtained from the inclination angle detection sensor 48 is equal to or more than a prescribed angle even within the tilt range, the setting permission section 60*b* transmits display data of a message for drawing attention to the service tool 100. FIG. 10 is a flow chart of such a process.

In Step b1, during an operation for setting the limit value, when the inclination angle of the outboard motor 3 obtained from the inclination angle detection sensor 48 is in the tilt range, setting the limit value can be started.

In Step b2, it is determined whether or not an angle sensor voltage obtained from the inclination angle detection sensor 48 is equal to or more than an angle caution determination voltage. Specifically, even if the angle sensor voltage obtained from the inclination angle detection sensor 48 is within a range from the halfway angle of 20 degrees to the upper limit angle of 76 degrees in the tilt range, it is determined whether or not the angle caution determination voltage is equal to or more than the limit value, for example, of 65 degrees.

In Step b3, when the angle sensor voltage obtained from the inclination angle detection sensor 48 is equal to or more than the angle caution determination voltage, an angle caution determination is made.

In Step b4, when the angle caution determination is made, display data of a message for drawing attention to angle caution determination information is transmitted to the service tool 100. When receiving the angle caution determination information from the controller 52, the service tool 100 displays a message for drawing attention to a setting display for the limit value.

As described above, during an operation for setting the limit value, when the inclination angle of the outboard motor 3 is equal to or more than a prescribed angle even within the tilt range, display data of a message for drawing attention is transmitted to the service tool 100. As a result, incorrect work can be prevented, and it is prevented that a portion of the outboard motor 3 interferes with the hull.

Figure 11:
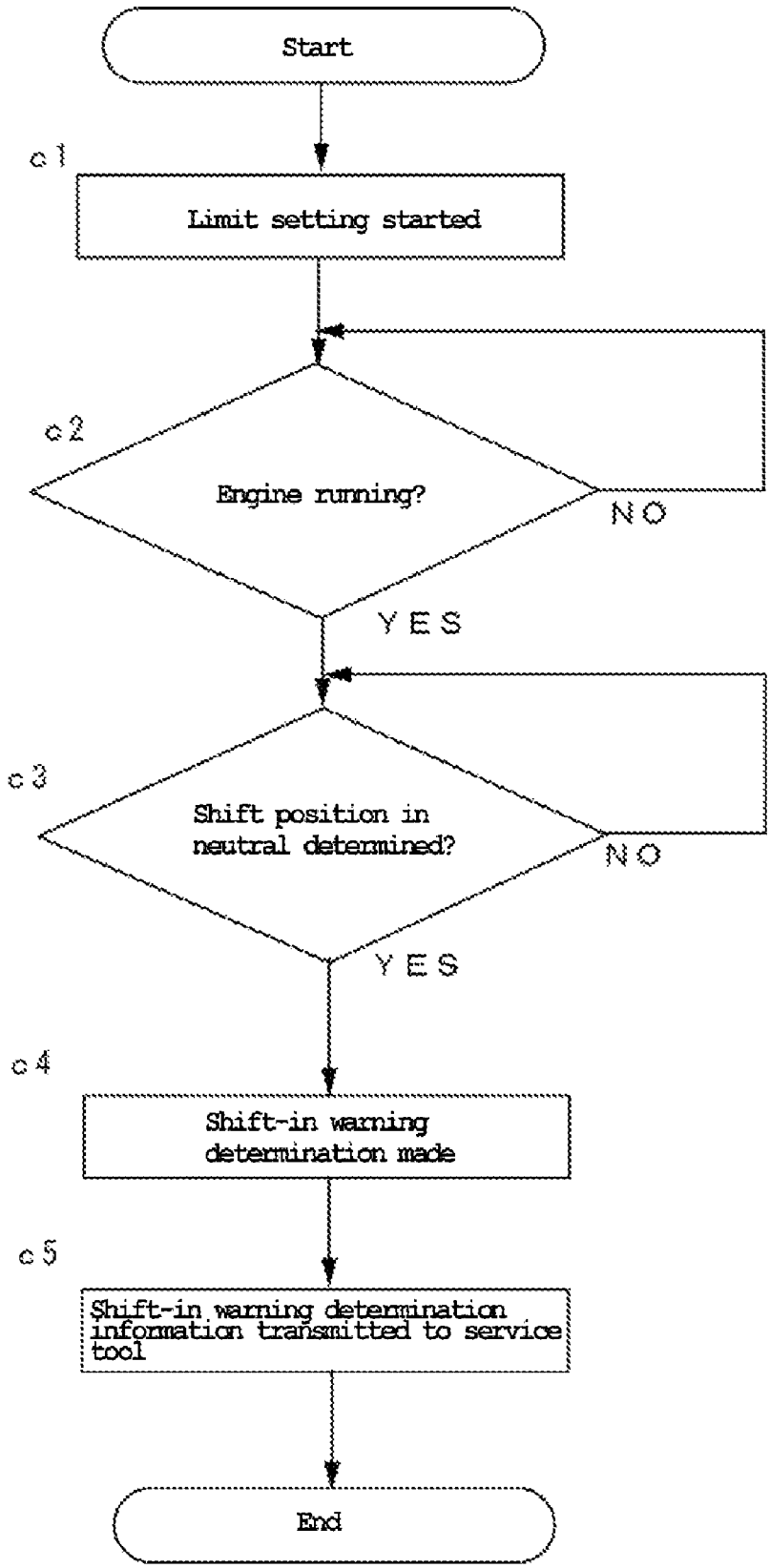
FIG. 11 is a flow chart of transmitting display data of a warning message to the service tool when it is detected that an engine is running or when it is detected that a shift position is input during an operation for setting a limit value.

Further, during an operation for setting the limit value, the setting permission section 60*b* can transmit display data of a warning message to the service tool 100 when it is detected that the engine 15 is running, or when it is detected that a shift position is input. FIG. 11 is a flow chart of such a process.

In Step c1, during an operation for setting the limit value, when the inclination angle of the outboard motor 3 obtained from the inclination angle detection sensor 48 is in the tilt range, setting the limit value can be started.

In Step c2, it is determined whether or not the engine 15 is running on the basis of the rotational speed signal of the engine 15 obtained from the crank angle signal detection sensor 61.

In Step c3, when the engine 15 is running, it is determined whether or not the shift position is in neutral.

In Step c4, when the shift position is not in neutral but in a forward drive position or in a reverse drive position, a shift-in warning determination is made.

In Step c5, when the shift-in warning determination is made, display data of a message for drawing attention to shift-in warning determination information is transmitted to the service tool 100. When receiving the shift-in warning determination information from the controller 52, the service tool 100 displays a message for drawing attention to the setting display for the limit value.

As described above, when it is detected that the engine 15 is running, or when it is detected that the shift position is input, display data of a warning message is transmitted to the service tool 100. As a result, it is possible to prompt the service staff to avoid a trim operation or a tilt operation in a situation in which the engine 15 is running or the shift is engaged.

Figure 12:
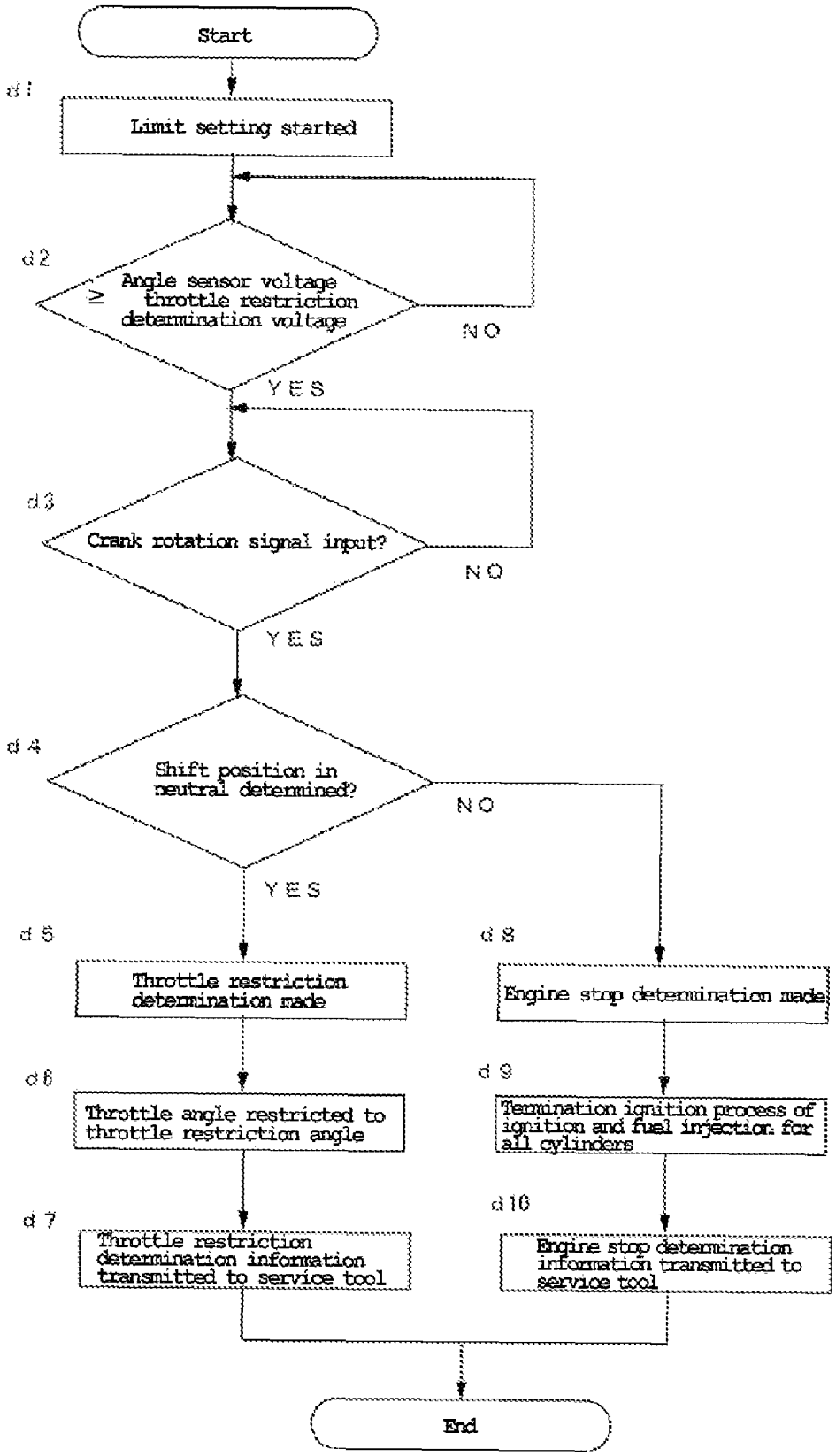
FIG. 12 is a flow chart of restricting a throttle opening of a throttle drive unit when an inclination angle with the engine running is equal to or more than a prescribed angle and of stopping the engine when the inclination angle is equal to or more than a prescribed angle with the engine running and with the shift engaged.

In addition, the setting permission section 60*b* restricts a throttle opening of the throttle drive unit 28 when the inclination angle of the outboard motor 3 obtained from the inclination angle detection sensor 48 by a trim operation or a tilt operation with the engine 15 running is equal to or more than a prescribed angle while the service tool 100 is connected. Further, when the inclination angle of the outboard motor 3 obtained from the inclination angle detection sensor 48 by a trim operation or a tilt operation with the engine 15 running and with the shift engaged is equal to or more than a prescribed angle, it is possible to stop the engine 15. FIG. 12 is a flow chart of such a process.

In Step d1, during an operation for setting the limit value, when the inclination angle of the outboard motor 3 obtained from the inclination angle detection sensor 48 is in the tilt range, setting the limit value can be started.

In Step d2, when a process for setting the limit value is started, it is determined whether or not the angle sensor voltage obtained from the inclination angle detection sensor 48 is equal to or more than a throttle restriction voltage.

In Step d3, when the angle sensor voltage is more than the throttle restriction voltage, it is determined whether or not the engine 15 is running on the basis of the rotational speed signal of the engine 15 obtained from the crank angle signal detection sensor 61.

In Step d4, when the engine 15 is running, it is determined whether or not the shift position is in neutral.

In Step d5, when the shift position is not in neutral but in a forward drive position or in a reverse drive position, a throttle restriction determination is made.

In Step d6, when the throttle restriction determination is made, the throttle opening is restricted to a throttle restriction angle.

In Step d7, display data of a message for drawing attention to throttle restriction determination information is transmitted to the service tool 100. When receiving the throttle restriction determination information from the controller 52, the service tool 100 displays a message for drawing attention to the setting display for the limit value.

In Step d8, when the shift position is not in neutral in the step d4, an engine stop determination is made.

In Step d9, when the engine stop determination is made, a process for stopping ignition and fuel injection in all cylinders of the engine 15 is performed.

In Step d10, display data of a message for drawing attention to engine stop determination information is transmitted to the service tool 100. When receiving the engine stop determination information from the controller 52, the service tool 100 displays a message for drawing attention to the setting display for the limit value.

As described above, when the inclination angle of the outboard motor 3 by a trim operation or a tilt operation with the engine 15 running is equal to or more than a prescribed angle, the throttle opening of the throttle drive unit 28 is restricted. Further, when the inclination angle of the outboard motor 3 by a trim operation or a tilt operation with the engine 15 running and with the shift engaged is equal to or more than a prescribed angle, the engine 15 is stopped. As a result, it is possible to prompt the service staff to avoid a trim operation or a tilt operation in a situation in which the engine 15 is running or the shift is engaged.

Figure 13:
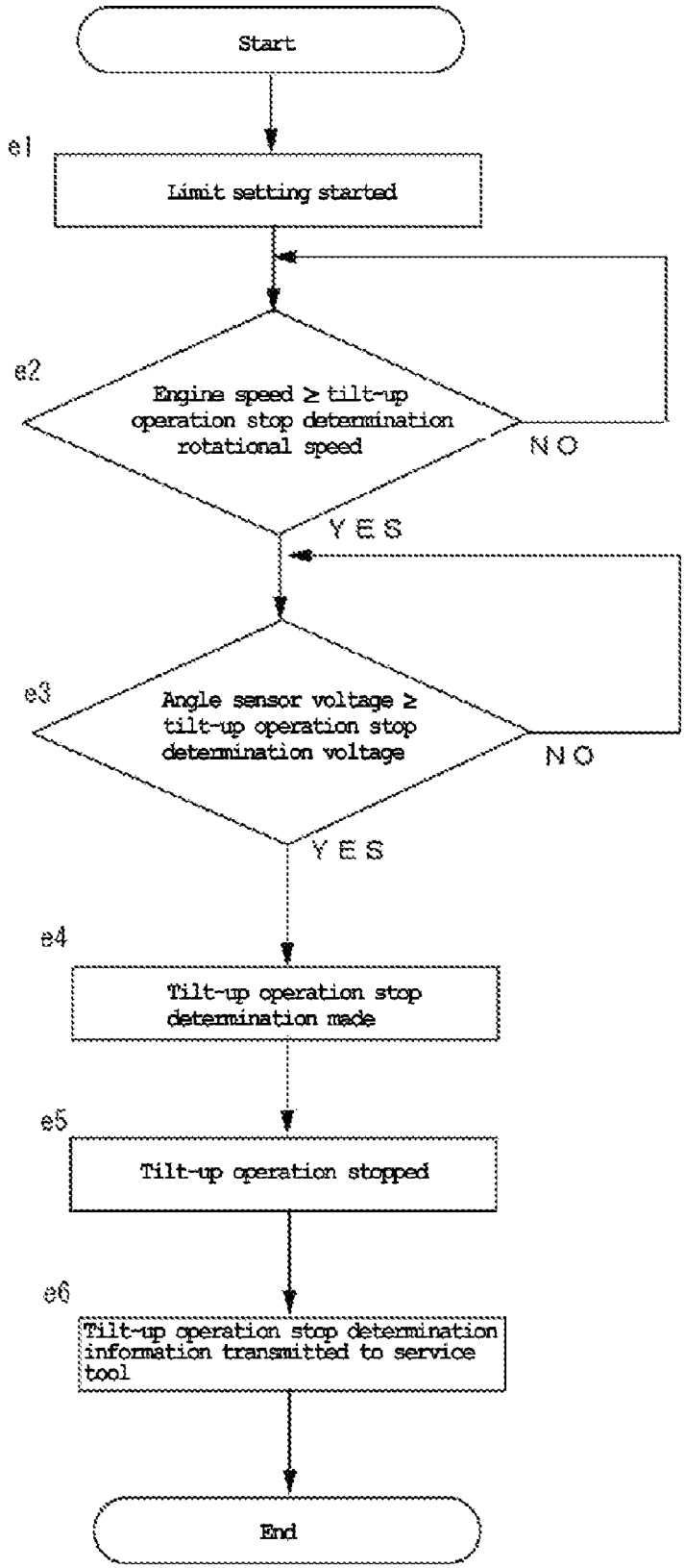
FIG. 13 is a flow chart of stopping a trim action or a tilt action when the inclination angle is equal to or more than a prescribed angle while engine speed is equal to or more than the prescribed speed.

Further, the setting permission section 60*b* can stop a trim operation or a tilt operation when the inclination angle of the outboard motor 3 obtained from the inclination angle detection sensor 48 by a trim operation or a tilt operation is equal to or more than a prescribed angle when the engine speed is equal to or more than a prescribed speed while the service tool 100 is connected. FIG. 13 is a flow chart of such a process.

In Step e1, during an operation for setting the limit value, when the inclination angle of the outboard motor 3 obtained from the inclination angle detection sensor 48 is in the tilt range, setting the limit value can be started.

In Step e2, when setting the limit value is started, it is determined whether or not the engine speed is equal to or more than an engine speed of an upward tilting operation stop determination for stopping a trim operation or a tilt operation on the basis of the rotational speed signal of the engine 15 obtained from the crank angle signal detection sensor 61 when the engine 15 is running.

In Step e3, when the engine speed is equal to or more than the engine speed of the upward tilting operation stop determination, it is determined whether or not the angle sensor voltage is equal to or more than a tilt-up operation stop determination voltage.

In Step e4, when the angle sensor voltage is equal to or more than the tilt-up operation stop determination voltage, the upward tilting operation stop determination is made.

In Step e5, when the upward tilting operation stop determination is made, tilting up the outboard motor 3 is stopped by stopping the hydraulic device 42 in accordance with an output from the trim tilt device 41.

In Step e6, display data of a message for drawing attention to upward tilting operation stop determination information is transmitted to the service tool 100. When receiving the upward tilting operation stop determination information from the controller 52, the service tool 100 displays a message for drawing attention to the setting display for the limit value.

As described above, while the engine speed is equal to or more than the prescribed speed, and the inclination angle of the outboard motor is equal to or more than the prescribed angle as a result of a trim operation or a tilt operation, the trim operation or the tilt operation is stopped. As a result, it is possible to prompt the service staff to avoid a trim operation or a tilt operation in a situation in which the engine 15 is running.

The present invention is preferably applied to a controller for a boat propulsion system capable of estimating a cause of trouble by connecting a service tool and which service staff can easily perform accurate work, and a boat propulsion system including the controller.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A controller for a boat propulsion system comprising:

an adjusting device arranged to adjust an inclination angle in a vertical direction of the boat propulsion system by a drive unit, the controller arranged to control the drive unit of the adjusting device;

a storage section arranged to store a limit value of the inclination angle; and a connector arranged to be in communication with a service tool; wherein the controller is arranged to set the limit value based on an input from the service tool through the connector and stop the drive unit when the inclination angle reaches the limit value.

2. The controller for a boat propulsion system according to claim 1, further comprising:

a storage section arranged to store an allowable inclination angle setting range; and a determination section arranged to determine whether the limit value is within the allowable inclination angle setting range.

3. The controller for a boat propulsion system according to claim 1, further comprising a setting permission section arranged to prohibit setting of the limit value when it is detected that an engine of the boat propulsion system is running.

4. The controller for a boat propulsion system according to claim 1, wherein the controller is arranged to store the limit value in a plurality of areas in the storage section, and the controller further includes a setting permission section arranged to determine whether the limit values stored in the plurality of the areas match.

5. The controller for a boat propulsion system according to claim 4, wherein the setting permission section transmits display data of a message for drawing attention to the service tool when the inclination angle is equal to or greater than a prescribed angle during an operation of setting the limit value.

6. The controller for a boat propulsion system according to claim 4, wherein the setting permission section transmits a display signal to a display device when it is determined that the limit value is out of the allowable inclination angle setting range during an operation of setting the limit value.

7. The controller for a boat propulsion system according to claim 1, further comprising a setting permission section arranged to reduce engine speed when the boat propulsion system is tilted to a prescribed angle or more while the engine is running.

8. The controller for a boat propulsion system according to claim 1, wherein the storage section is arranged to store a plurality of different limit values.

9. The controller for a boat propulsion system according to claim 1, wherein the limit value stored in the storage section can be initialized by an operation of the service tool.

10. The controller for a boat propulsion system according to claim 1, wherein the controller is arranged to stop the engine when the inclination angle is equal to or more than a prescribed value while an engine speed is equal to or more than a prescribed speed with a shift position in a forward drive or a reverse drive.

11. The controller for a boat propulsion system according to claim 8, wherein the controller is arranged to change the limit value in accordance with the engine speed.

12. A boat propulsion system comprising the controller according to claim 1.

* * * * *